US005622159A

United States Patent [19]

Liu et al.

[11] Patent Number: 5,622,159

[45] Date of Patent: Apr. 22, 1997

[54] TOY WEAPON FIRING A SHAPELESS SEMI-SOLID CHARGE

[75] Inventors: Dexter C. T. Liu, Portsmouth, R.I.; Douglas Melville, Jr., Simsbury, Conn.

[73] Assignee: LCD International, L.L.C., Newport, R.I.

[21] Appl. No.: 435,643

[22] Filed: May 5, 1995

[51] Int. Cl.[6] ..... F41B 11/00

[52] U.S. Cl. ..... 124/66; 124/65; 124/64; 222/79

[58] Field of Search ..... 124/64, 65, 66, 124/67; 222/79, 390, 391; 446/478

[56] References Cited

U.S. PATENT DOCUMENTS

| | | | |
|---|---|---|---|
| 964,810 | 7/1910 | Rieger | 124/65 |
| 2,566,487 | 9/1951 | Gora et al. | 222/79 |
| 2,706,067 | 4/1955 | Mills | 222/79 |
| 2,753,079 | 7/1956 | Hersey | 222/324 |
| 2,754,997 | 7/1956 | Hopkins et al. | 222/79 |
| 2,900,972 | 8/1959 | Marsh et al. | 124/63 |
| 3,029,539 | 4/1962 | Glass et al. | 124/83 X |
| 3,191,070 | 6/1965 | Pearl et al. | 222/79 |
| 3,438,547 | 4/1969 | Pereida et al. | 222/79 |
| 3,443,725 | 5/1969 | Lawhorn | 222/79 |
| 3,536,054 | 10/1970 | Stephens et al. | 124/11 |
| 3,758,005 | 9/1973 | Christine et al. | 222/380 |
| 3,782,598 | 1/1974 | Basa | 222/340 |
| 3,823,847 | 7/1974 | Ware | 124/67 X |
| 4,114,080 | 9/1978 | Greenwood | 446/405 |
| 4,630,757 | 12/1986 | Yano | 222/79 |
| 4,733,799 | 3/1988 | Wiskur | 222/79 |
| 4,765,510 | 8/1988 | Rende | 222/39 |
| 4,834,059 | 5/1989 | Moorhouse et al. | 124/67 |
| 4,871,094 | 10/1989 | Gall et al. | 222/386 |
| 5,052,587 | 10/1991 | Graves | 222/79 |
| 5,150,819 | 9/1992 | Johnson et al. | 222/79 |
| 5,184,756 | 2/1993 | Amron | 222/79 |
| 5,197,637 | 3/1993 | Naumann | 222/494 |
| 5,241,944 | 9/1993 | Rappaport | 124/67 |
| 5,267,549 | 12/1993 | Webber | 124/65 |
| 5,284,274 | 2/1994 | Lee et al. | 222/79 |
| 5,295,614 | 3/1994 | Chang | 222/391 X |
| 5,322,191 | 6/1994 | Johnson et al. | 222/79 |
| 5,373,833 | 12/1994 | D'Andrade | 124/73 X |
| 5,411,211 | 5/1995 | Greene et al. | 222/391 X |
| 5,419,458 | 5/1995 | Mayer | 222/91 X |
| 5,448,984 | 9/1995 | Borvelli | 124/69 |
| 5,514,135 | 5/1996 | Earle | 222/391 X |

FOREIGN PATENT DOCUMENTS

| | | | |
|---|---|---|---|
| 948930 | 3/1953 | Germany | 222/79 |

*Primary Examiner*—Randolph A. Reese
*Assistant Examiner*—Thomas A. Beach
*Attorney, Agent, or Firm*—Panitch Schwarze Jacobs & Nadel, P.C.

[57] ABSTRACT

A toy weapon firing a shapeless solid charge includes a reciprocating air pump and an extruder including a reservoir of the shapeless flowable solid material. A tubular nozzle member is mounted on the outlet end of the air pump and includes a transversely extending nipple providing a fluid coupling with the outlet of the extruder. A portion of the housing is configured to form a hand grip while a separate hand grip is coupled with the air pump piston to permit reciprocation of the air pump piston by reciprocating the hand grip portions towards one another and away from one another. The extruder may be operated separately from the air pump or linked with the air pump for simultaneous operation to feed a charge of the shapeless, flowable solid material into the nozzle member before or while the air pump is reciprocated.

27 Claims, 5 Drawing Sheets

TOY WEAPON FIRING A SHAPELESS SEMI-SOLID CHARGE

FIELD OF THE INVENTION

The invention relates to toy weapons and, in particular, air powered toy weapons for firing toy projectiles.

BACKGROUND OF THE INVENTION

Firearm simulating weapon toys, which fire either a liquid or solid objects, are well known. Such liquid and solid object-firing toy weapons are particularly enjoyed because they raise the level of realistic play above non-liquid or object-firing toy weapons.

It is believed that a high level of enjoyment is achieved by users of such toys when such toys most closely simulate real firearms. In particular, it is believed desirable to simulate firearms by projecting a real object (charge of liquid or solid object) at an opponent so that if the shooter's aim is sufficiently good, the opponent is actually hit.

In addition, it is believed that such toy users also highly regard those types of shooting toys which safely mark an opponent who is hit to preclude any disagreements as to whether a hit occurred. Water pistols have always been highly regarded in that the person (or object) struck is wetted and confirmation of the hit can be easily made. Generally speaking, solid object-firing projectile do not mark a struck opponent and therefore, are not as satisfactory as water pistols in this particular regard.

One class of toy weapon has been developed which is safe for adults and children of all ages. This class includes light firing toy weapons and light-sensitive targets worn by the participants. The drawback of such systems is that the light-responsive targets typically have only a limited field of view so that if the light source is not sufficiently aligned with the target, such targets will not respond as being struck even though the player wearing the target was illuminated by the light beam.

Adults have raised the level of realism with the use of paint-ball firing guns. Paint-filled gelatin balls are fired by condensed $CO_2$ gas or compressed air for relatively long distances. Such paint balls spatter their contents over whatever object they may hit. Such weapons and projectiles, while generally safe, still carry an element of significant potential danger considering their size and the velocity at which they are propelled. Accordingly, users are typically adults and older teenagers and conventionally wear protective clothing to cushion the impact of being struck and to protect themselves against the contents of the balls.

U.S. Pat. No. 5,241,944 discloses an interesting hybrid weapon firing a water-soaked solid foam projectile. This device combines the bullet-simulating characteristics of a solid projectile firing toy weapon with the potential marking and wetting capability of a water pistol. Such weapon would be safe for children.

It is believed that different realistic simulated toy weapons would be greatly desired by those who play with such weapons, if such realistic simulated toy weapon could be devised and safely used.

SUMMARY OF THE INVENTION

In one aspect, the invention is a toy weapon for firing a charge of a shapeless, flowable, semi-solid material comprising: a tube having an outlet exposed to atmosphere at one end; an extruder including a reservoir adapted to retain a quantity of the shapeless, flowable, semi-solid material, the extruder being fluidly coupled to atmosphere through the tube; a piston mounted to reciprocate in the tube; and a first hand grip coupled with at least one of the extruder, the tube and the piston.

In yet another aspect, the invention is a toy weapon for firing a charge of a shapeless flowable, semi-solid material comprising: a passageway having an outlet at one end open to atmosphere; an air pump configured to expel air through the passageway; and a reservoir for the shapeless, flowable, semi-solid material the reservoir having at least one end opened to atmosphere through the passageway.

In still another aspect, the invention is a toy weapon for firing a charge of a shapeless, flowable, semi-solid material comprising: a nozzle having an outlet at one end exposed to atmosphere and an internal cross-sectional diameter tapering down as the nozzle extends towards the outlet; an air pump including a barrel and reciprocating piston, the barrel and the piston being axially aligned with the nozzle; an extruder having an outlet end fluidly between the outlet and the air pump; and a first hand grip coupled with at least one of the extruder and the air pump, the toy weapon being sufficiently small and light to be manually supported by a child with the first hand grip.

BRIEF DESCRIPTION OF THE DRAWINGS

The foregoing summary, as well as the following detailed description of the preferred embodiments, is better understood when read in conjunction with the appended diagrammatic drawings. For the purpose of illustrating the invention, there is shown in the drawings an embodiment which is presently preferred. It should be understood, however, that the invention is not limited to the specific instrumentalities, arrangements or methods disclosed. In the drawings which are diagrammatic.

DESCRIPTION OF THE PREFERRED EMBODIMENT

Figures 1, 3:
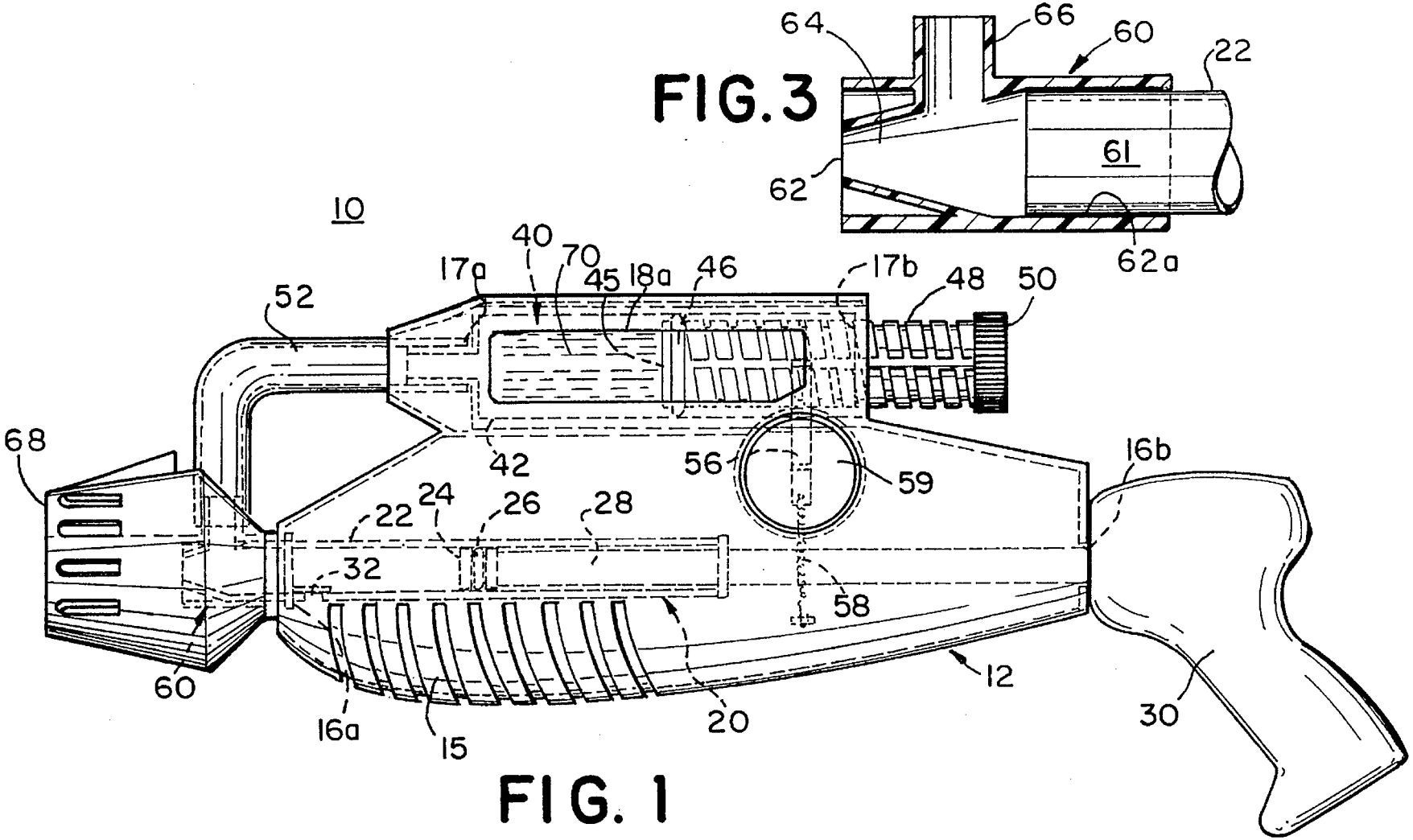
FIG. 1 is a side elevation view of a first embodiment toy weapon according to the present invention.
FIG. 3 is a sectioned side elevation of a nozzle member taken along the lines 3—3 of FIG. 2.

Certain terminology is used in the following description for convention only and is not limiting. The words "right," "left," "lower," "upper," "top," "bottom," "horizontal," "vertical," "forward," "rearward," "backward" and "under" designate directions in the drawings to which reference is made. The words "inward" and "outward" refer to directions towards and away from, respectively, the geometric center of the device or designated parts thereof.

Figure 2:
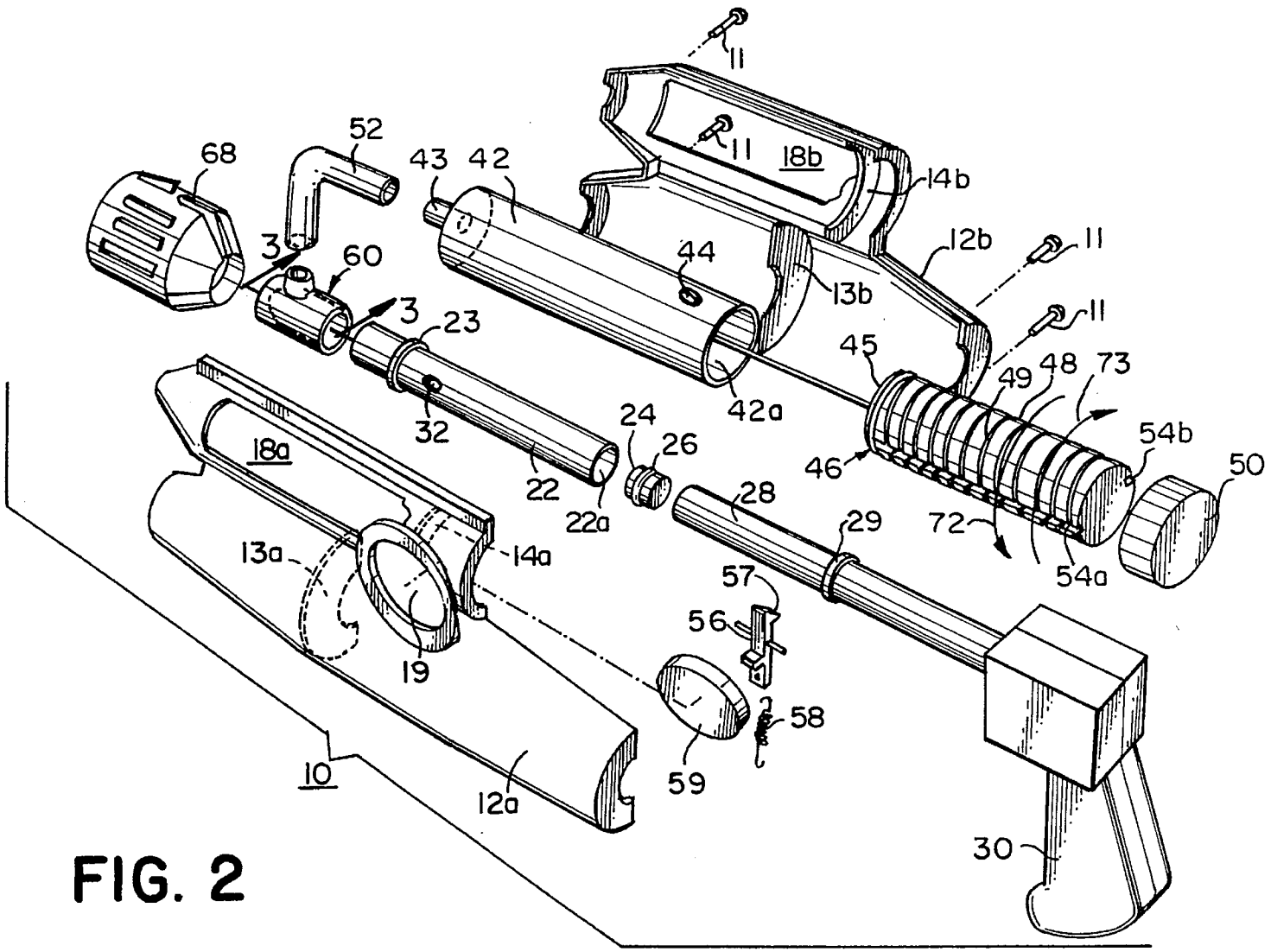
FIG. 2 is an exploded view of the weapon of FIG. 1.

Referring now to the drawings in which like numerals are used to reference the like elements throughout, there is shown in FIGS. 1 and 2, an air-powered toy weapon indicated generally at 10 for firing a charge of a shapeless, flowable, semi-solid material indicated generally at 70. Major components of the toy weapon 10 are seen partially in phantom in FIG. 1. The weapon 10 has three major preferred components: a housing 12, an air pump indicated generally at 20, an extruder indicated generally at 40 and a nozzle member indicated generally at 60.

Referring to FIG. 2, the housing 12 may be provided in any of a variety of ways. A pair of mating shells 12*a*, 12*b* is preferred. The shells may be held together with removable fasteners 11, fixed fasteners (not depicted), or other conventional means.

Still referring to FIG. 2, the air pump 20 preferably includes a hollow cylindrical member 22 forming a barrel of the pump and a piston 24 mounted to reciprocate and, in particular, reciprocate freely within the barrel 22. One or more air seal members, preferably one or more O-rings 26, are provided on the piston to extend and form an air seal between the piston and the inner cylindrical surface 22*a* of the barrel 22. Any other conventional air pump construction, for example, one employing a flexible cup as both piston and seal, might be employed in the alternative. Piston 24 is secured to one end of a shaft 28 which projects out a rear end of the barrel 22 and through a lower rear opening 16*b* (FIG. 1) of the housing. The remaining end of the shaft mounts or is formed in the shape of a hand grip, preferably a pistol grip 30 as shown, for ease of use.

Barrel 22 is preferably mounted within and secured with the housing 12. Preferably, a forward or output end of the barrel 22 projects through a lower forward opening 16*a* in the housing (see FIG. 1) and is fluidly and preferably directly physically coupled with nozzle member 60. The forward end of the barrel 22 may be secured to the housing by means of a stop 23 formed or otherwise provided on the forward end of the barrel 22, which interferes with the inner side of the housing 12 at opening 16*a*. The nozzle member 60 may be mounted over and secured to the projecting end of the barrel 22 so as to trap the forward end of the barrel 22 in the opening 16*a* and to form a unitary straight tube with the barrel 22. Preferably, simple means such as ribs 13*a*, 13*b* may be provided within the housing 12 to support and/or restrict movement of the remaining end of the barrel 22. Shaft 28 and piston 24 may be similarly retained within the housing 12 by the provision of a stop 29 on shaft 28, which interferes with the rear end of the housing when the shaft is withdrawn from the barrel 22. Although the diameter of the air pump barrel 22 is indicated to be slightly less than to that of the nozzle member 40, the barrel can be of an equal diameter or of a greater or even lesser diameter than that of the nozzle, as desired. Barrel 22 and nozzle member 60 together define a generally straight main passageway having one end continuously open to atmosphere at the nozzle member 60.

Preferably, a forward lower end of the housing 12 is configured, for example, by being knurled, to define another hand grip portion, indicated generally as 15. Preferably, this is a grip extending longitudinally along the housing 12. However, another pistol grip could have been provided. Hand grip portion 15 is coupled and effectively secured with the barrel 22 through the remainder of the housing 12. Hand grip portion 15 allows the remainder of the weapon 10 to be grasped while the user reciprocates the air pump piston 24 with the pistol grip 30 and with respect to the hand grip portion 15 and the tube formed by nozzle member 60 and barrel 22.

If desired, a one-way valve 32, for example a flap-type valve 32, may be provided along an opening through the barrel 22 proximal its forward end, between the nozzle 60 in the forward-most position of the piston 24. The valve is oriented to pass air only from atmosphere into the barrel 22 so as to provide a fluid coupling of the barrel to atmosphere independent of a fluid coupling to atmosphere provided the barrel 22 by nozzle member 60.

The extruder 40 is preferably provided by another hollow cylindrical member or barrel 42, which acts as a reservoir storing the semi-solid material 70 (FIG. 1). Another piston 45 is slidably received to reciprocate within the barrel/reservoir 42. Again, if needed or desired, one or more O-rings 46 or other seal member(s) may be provided around (or on) the piston 45 to form a seal between the piston 45 and an inner cylindrical surface 42*a* of the extruder barrel/reservoir 42.

Front and rear opening 17*a*, 17*b*, respectively, (FIG. 1) are provided in the housing 12 to receive the extruder 40. A forward or outlet or feed open end of the barrel/reservoir 42 is fluidly coupled with nozzle 60 through nipple 43 and a tube 52.

Nipple 43 and tube 52 collectively define a feed passageway having only two ends which terminate at the feed open end of the reservoir 42 and the nozzle 60 portion of the main passageway of the weapon. The feed passageway directs the semi-solid material forced from the reservoir 42 of extruder 40 only to that main passageway. Preferably, barrel/reservoir 42 is secured within the housing 12 by extending nipple 43 through an opening 18*a* in the upper end of the housing 12 and applying an end of the tube 52 over the exposed, distal end of the nipple. Tube 52 overlaps the opening 18*a* so as to trap the nipple 43 of the barrel 42 in the opening 18*a*. Again, a rib or ribs 14*a*, 14*b* may be provided, if desired or necessary, to support and/or immobilize the remaining rear end of the barrel/reservoir 42. Openings 18*a*, 18*b* are provided through the housing shell halves 12*a*, 12*b*, respectively, to permit viewing of the contents of the semi-solid material in the barrel/reservoir 42. An opening 44 is provided through barrel/reservoir 42. Opening 44 is further exposed at a rearmost end of housing opening 18*a*.

Piston 45 preferably is secured with one end of a shaft in the form of a screw member 48, preferably by being formed together in one piece. Screw member 48 is preferably provided along at least part of its length with a spiral screw slot 49. Preferably, the rear opening 18*b* of the housing 12, which receives member 48, is sized and shaped to threadingly engage the screw slot 49. Alternatively, a separate, internally threaded member, threadingly mating with the screw slot 49, can be provided and secured to the housing 12. In the extreme rear end of the screw member 48 extruder 40 may be coupled with a hand grip portion in the form of a knurled cap 50 for ease of use.

The toy weapon 10 is preferably provided with a mechanism for metering the shapeless, semi-solid, flowable material 70 from the extruder 40 into the nozzle member 60. In the preferred embodiment depicted, the metering mechanism is provided by one or more axially extending slots along screw member 48, two slots 54*a*, 54*b* being shown and a latch member 56, which is positioned and preferably pivotally supported within the housing 12 with an engagement end 57 which contacts the surface of the screw member 48 to engage either slot 54*a*, 54*b* as it passes under the end 57. The latch member 56 is preferably biased by suitable means such as a coil spring member 58 having one end secured with a remaining end of the latch member 56 and another end is secured with the housing 12 so as to bias the engagement end 57 of the latch member 56 into each underlying slot 54*a*, 54*b*. A release button 59 is provided through a button opening 19 in one of the housing shell halves 12*a* and is positioned to depress one end of the latch member 56 when the button 59 is depressed, thereby disengaging the engagement end 57 of that member from either slot 54*a*, 54*b*. Thus, the screw member 48 with extruder piston 45 is rotatably coupled to housing 12 and with respect to reservoir barrel 42 to advance into the barrel and thereby reduce its storage capacity—expelling semi-solid material 70. Latch member 56 secures the piston/screw member combination at any of a plurality of positions along the extruder barrel/reservoir 42.

Referring now to FIG. 3, the nozzle member 60 is shown in greater detail. The nozzle member 60 includes a primary, axially extending passageway indicated generally at 61, which terminates at one end of the member 60 in an outlet 62 exposed to atmosphere. A portion of the passageway 61 approaching the outlet 62 has an internal surface 62*a*, which tapers down in internal cross-sectional diameter as it extends towards and preferably to the outlet 62 to define a funnel-shaped constriction indicated generally at 64, along the passageway 61, which is a nozzle. The remaining end of the passageway 61, opposite the outlet 62, receives the forward end of the air pump barrel 22 (indicated in phantom). A hollow nipple 66 provided along the nozzle member 60 between the funnel-shaped constriction 64 and end of the air pump barrel 22 receives an end of the tube 52 extending from extruder 40. In this way, the reservoir 40 is fluidly coupled to atmosphere through the outlet 62 and to the tube formed by nozzle member 60 and barrel 22 between the constriction 64 and the terminal end of air pump piston 24. In the same way, passageway 61 fluidly couples the air pump 20 and particularly the barrel 22 of air pump 20 to atmosphere through the outlet 62. The main passageway formed by nozzle member 60 and barrel 20 and the feed passageway formed by nipple 43 and tube 52 are, apart from any of the semi-solid material which either may contain during operation, opened continuously to atmosphere, there being no valving or other structural member(s) blocking either passageway from atmosphere at the outlet 62. Lastly, a simulated flash suppressor 68 is mounted on the end of the nozzle 60 to protect the forward end of the toy weapon 10 and for decorative effect.

Operation of the toy weapon 10 is as follows. First, release button 59 is depressed, releasing the engagement end 57 of latch member 56 from any axial slot 54*a*, 54*b* which may be engaged with or which might engage with the engagement end 57 of the latch member 56. The screw member 48 rotated in a counterclockwise direction as indicated by arrow 72 until the extruder piston 45 is backed past fill opening 44 in the extruder reservoir 42. A quantity of the shapeless, semi-solid, flowable material 70 is then loaded through the housing opening 18*a* and fill opening 44 into the reservoir 42. Gripping the cap 50, screw member 48 is rotated in a clockwise direction as indicated by arrow 73 to advance piston 45 through the extruder barrel 42 until the extruder piston 45 at least travels forward past and closes the fill opening 44. Preferably, the screw member 48 is advanced sufficiently to extrude a portion of the material 70 through the nipple 43 and tube 52 until the material 70 is about to enter a chamber 67 defined within the nozzle member 60 along passageway 61 between outlet 62 and the extreme forward end of air pump barrel 22 and preferably directly into the constriction 64.

Use of the toy weapon 10 will a vary slightly depending upon whether a one-way valve 32 is provided. If the valve is not provided, the air pump piston 24 is initially withdrawn in the barrel 22 away from the outlet 62 end of the weapon. This can be done by gripping and pulling on pistol grip 30 while holding onto the hand grip portion 15 of the housing 12. If one-way valve 32 is provided, the air pump piston 24 can be left partially or fully depressed in the barrel 22. Screw member 48 is then rotated in a clockwise direction 73 to advance extruder piston 45 through the extruder barrel 42 and to extrude a charge of the shapeless, semi-solid, flowable material 70 into the chamber 67 of nozzle member 60. Enough of the material 70 is extruded into the chamber 67 to fully block passageway 61 or to at least block passageway 61 sufficiently so that air may be compressed within the air pump 20 behind the material. If it has not already been withdrawn, the pump piston 24 is withdrawn as indicated above so that air is collected in the air pump barrel 22 in front of the piston 24.

To fire the charge of shapeless, semi-solid material 70, the hand grip portion 15 is grasped and the pistol grip 30 attached to the air pump piston 24 is grasped and pushed in a forward direction towards the outlet 62. Air trapped in the air pump barrel 22 is compressed behind the charge of semi-solid material in the nozzle member 60, forcing that charge through the funnel-shaped constriction 64 and the outlet 62. The nozzle effect provided by funnel shaped constriction 64 is important in that it retards movement of the semi-solid material charge to the outlet 62 and permits a significant pressure to be developed in the air pump 20 behind the material charge in the nozzle member 60. This transfers more energy to the charge and provides a higher discharge velocity and greater range. The constriction 64 further assists in keeping a material charge in the nozzle member 60 as the semi-solid material will have a tendency to creep from the weapon 10 if the weapon is left to sit. These steps can be repeated to fire additional charges.

Figure 4:
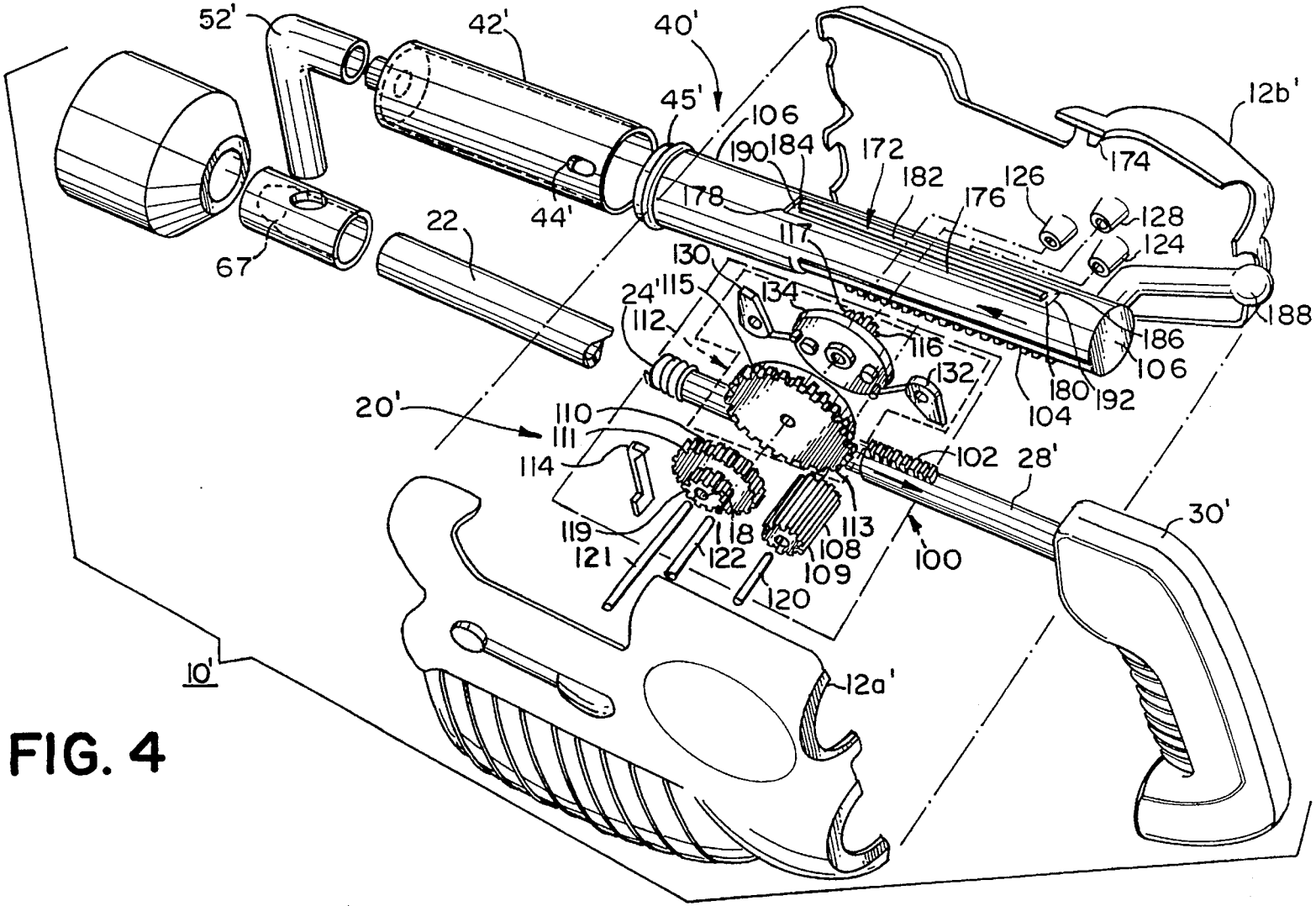
FIG. 4 is an exploded view of a second embodiment toy weapon of the present invention.

FIG. 4 shows an exploded view of a toy weapon 10' having an alternative embodiment of the charge extruding/advancing mechanism shown in FIGS. 1 and 2. The alternative embodiment allows a metered amount of charge to be automatically extruded into the chamber 67 of the nozzle member 60 every time that the air pump piston 24' is withdrawn. Thus, the user need not perform any additional manual steps to extrude the next charge to be fired from the weapon 10'. FIG. 4 also shows an alternative embodiment of a charge loading mechanism to replace the screw embodiment shown in FIGS. 1 and 2.

Referring to FIG. 4, the automatic metering feature employs a gear train indicated generally at 100 for advancing charge feeding extruder piston 45' every time that the air pump piston 24' is retracted from the fired position. Generally, a rack 102 provided on the top of shaft 28' engages, one gear, an input or first gear in the form of an input pinion 108, of the gear train 100. Rotation of the input gear 108 is transferred to another gear through the gearing of the gear train 100 to an output gear in the form of a pinion 116, which, in turn, engages a rack 104 provided in the bottom of shaft 106 of the charge feeding extruder piston 45'.

More specifically, the gear train 100 includes the input or first gear or pinion 108, a second gear 110 and an output gear assembly indicated generally at 112 supporting output gear/pinion 116. Input gear/pinion 108 has teeth 109. Sets of teeth 111 and 113 are formed along the outer circumference of the second gear 110 and output gear assembly 112, respectively. Spur gear 118 extends from the center of one side of the second gear 110 while output gear/pinion 116 extends from one side of the output gear assembly 112, respectively. The outer diameters of the gears 118 and 116 are smaller than the outer diameters of the second gear and output gear assembly 112, respectively. Gear 118 has a set of teeth 119 along its outer circumference, and output gear/pinion 116 has a set of teeth 117 along its outer circumference. Gears 108 and 110 are shown on the left side of output gear assembly 112 in FIG. 4 only for clarity. They are installed on the right side of output gear assembly 112 when the weapon 10' is assembled so that teeth 119 align with teeth 113.

In operation, retraction of the air pump piston 24' causes advancement of the charge feeding extruder piston 45' in the following manner. As the rack 102 travels under the first gear 108, a bottom region of the first gear's set of teeth 109 intermeshes with the rack 102. Simultaneously, an adjoining region of the set of teeth 109 of the first gear 108 intermeshes with the set of teeth 111 of the second gear 110. Teeth 119 of the spur gear 118 intermesh with the set of teeth 113 of the output gear assembly 112. A top region of the set of teeth 117 of the output gear/pinion 116 of the output gear assembly 112 intermeshes with the rack 104, causing forward movement of the rack 104 and piston 106. As described in more detail below, when a charge is fired by advancing the air pump piston 24' from a fully retracted position to a fully forward position, similar gear movements occur. However, because of the construction of the output gear assembly 112, the output gear/pinion 116 remains stationary. Thus, when the charge is fired, rotation of the first and second gears 108, 110 and output gear assembly 112 does not cause the rack 104 to move.

The gear train 100 also includes holding pawl 114. The upper end of the holding pawl 114 engages the teeth 117 of the output gear/pinion 116. The holding pawl 114 prevents back pressure in the flowable, semi-solid material in the barrel 42' and tube 52' from driving the gearing of the output gear assembly 112 in a reverse direction.

The output gear assembly 112 is a double gear with an internal ratchet. The output gear assembly 112 includes outer wheel 115, inner wheel 134, and preferably identical first and second pawls 130 and 132, respectively. The set of teeth 113 of the output gear assembly 112 are disposed along the outer circumference of the outer wheel 115. The output gear/pinion 116 extends from the center of the inner wheel 134.

Figure 5:
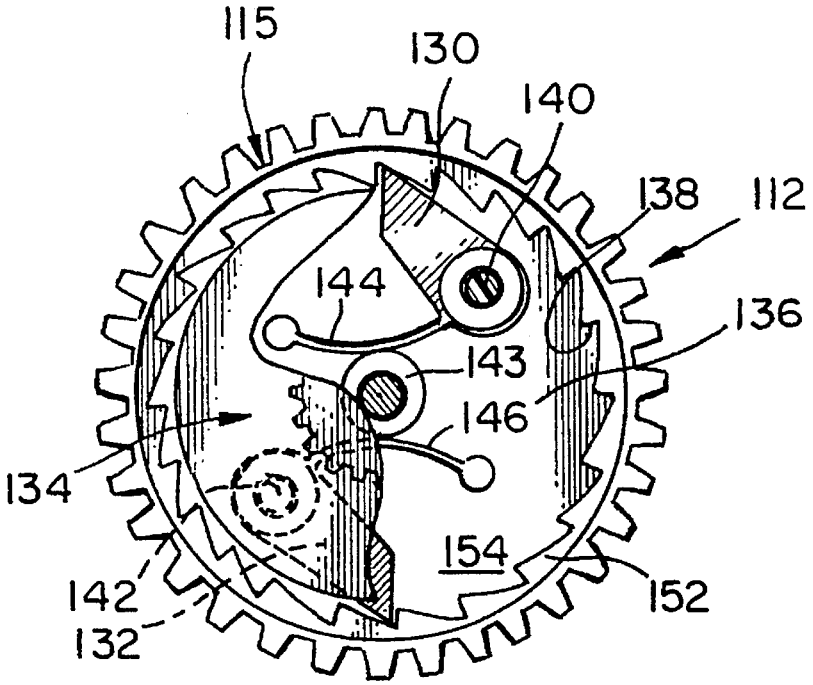
FIG. 5 is a partially broken away elevation of an output gear assembly of the toy weapon of FIG. 4.

The parts and operation of the output gear assembly 112 are further understood with respect to FIG. 5 which is a view of an assembled output gear assembly 112 with a portion broken away to show the arrangement of the internal parts. As noted above, the output gear assembly 112 includes the outer wheel 115, inner wheel 134, and first and second pawls 130 and 132. The outer wheel 115 has a flange or ring 152 extending from its "inner" surface 154. The inner surface 154 of ring 152 defines a cylindrical cavity 136 in the outer wheel 115 for receiving the inner wheel 134 therein. A set of ratchet teeth 138 are formed along the inner circumference of the ring 152. Each tooth 138 is wedge-shaped. The raised portion of each tooth 138 is adjacent to the lower portion of the next adjacent tooth 138. The ratchet teeth 138, the inner wheel 134, and pawls 130 and 132 form a ratchet and pawl or more generally, a one-way or slip clutch mechanism. Other known types of slip clutch mechanisms may be substituted for the ratchet and pawl mechanism described herein.

The inner wheel 134 includes opposed posts 140 and 142 and may include a hollow center post 143. The posts 140 and 142 extend from a mid-region of the side of the inner wheel 134 which faces the outer wheel 115. The set of teeth 117 of the output gear/pinion 116 project from the other side of the inner wheel. The pawls 130 and 132 are pivotally supported by the posts 140 and 142, respectively. Each pawl 130 and 132 also optionally includes a flexible rib 144 and 146, respectively, for bracing the pawls 130 and 132 against the ring 152. The pawls 130 and 132 are dimensioned so that they extend past the outer diameter of the inner wheel 134 and engage the ratchet teeth 138 of the outer wheel 115. FIG. 5 shows how one of the pawls 130 is positioned on the in the cavity 136 of the outer wheel 115.

Referring again to FIG. 4, the first and second gears 108, 110 and output gear assembly 112 of the gear train 100 are mounted to the housing shell of the weapon 10' by three shafts 120, 121 and 122. The three shafts 120, 121 and 122 extend from housing shell portion **12*a*' through center openings in respective gear members to the other housing shell portion 12*b*'. More specifically, shaft 120 supports the first gear 108, shaft 121 supports the second gear 110 and shaft 122 supports the output gear assembly 112 for free rotation about the shafts. Each end of the shafts 120, 121 and 122 is received by journals in the form of hollowed projections extending inward from the inner surfaces of the two housing shell portions 12*a*' and 12*b*'. Three such projections 124, 126 and 128 associated with the housing shell portion 12*b*' are visible in FIG. 4. The projections associated with the housing shell portion 12*a*' are not visible in this view. Each of the cavities of the projections 124, 126 and 128 receive one end of the shafts 120, 121 and 122, respectively. Due to the mounting structure, the first and second gears 108, 110 and output gear assembly 112 cannot move either horizontally or vertically as the rack 102 passes under the gear train 100. Thus, the rack 102 transfers only rotational movement to the first and second gears 108, 110 and output gear assembly 112**.

Operation of the toy weapon 10' will now be described with particular reference to FIG. 4. As noted above, the gear train 100 works in conjunction with the racks 102 and 104 to advance the charge feeding extruder piston 45' every time that the air pump piston 24' is retracted from the fired position. The rack 102 is built into a mid-region of the top of the shaft 28'. The rack 104 is built into a generally rearward portion of the bottom of the piston shaft 106. The rack 102 is positioned relative to the first gear 108 so that as the air pump piston 24' is retracted, the teeth of the rack 102 interengage the teeth of the first or input gear/pinion 108. Interengagement occurs at the end of the retraction stroke of the piston shaft 106, after air has been drawn into the air pump barrel 22 by the piston 24'. Upon interengagement, continued retraction of the piston shaft 106 causes the first gear/pinion 108 to rotate in the counterclockwise direction. The counterclockwise rotation of the first gear/pinion 108 causes clockwise rotation of the second gear 110, which, in turn, causes counterclockwise rotation of the output gear assembly 112. The pawls 140 and 142 of the output gear assembly 112 prevent the inner wheel 134 of the output gear assembly 112 from slipping or ratcheting within the cavity 136. Thus, the inner wheel 134 moves in tandem with the outer wheel 115. Accordingly, as the output gear assembly 112 rotates counterclockwise, the output gear/pinion 116 of the inner wheel 134 also rotates counterclockwise. Since the set of teeth 117 of the output gear/pinion 116 interengages the teeth of the rack 104, the counterclockwise rotation of the output gear/pinion 116 advances the charge feeding extruder piston 45' by a predetermined distance. The predetermined distance is a function of the length of the rack 102 and the gearing ratios of the rotating parts of the gear train 100. The predetermined distance should be selected so as to allow a suitable amount of charge to flow into the nozzle chamber 67.

Still referring to FIG. 4, when a charge is fired by advancing the air pump piston 24' from a fully retracted position to a fully forward position, the teeth of the rack 102 interengage the teeth 109 of the first gear/pinion 108 as the rack 102 passes under the first gear/pinion 108, thereby causing the first gear/pinion 108 to rotate in the clockwise direction. The clockwise rotation of the first gear/pinion 108 causes counterclockwise rotation of the second gear 110, which, in turn, causes clockwise rotation of the outer wheel 115 of the output gear assembly 112. However, due to the ratchet and pawl mechanism of the output gear assembly 112, the inner wheel 134 does not move in tandem with the outer wheel 115. Instead, the pawls 140 and 142 of the inner wheel 134 slip along the ratchet teeth 138 of the outer wheel 115 as the outer wheel 115 turns. Thus, the inner wheel 134 remains stationary as the outer wheel 113 rotates clockwise. Since the inner wheel 134 does not rotate during weapon firing, the charge feeding extruder piston 45' does not move backward, as would occur if there was no ratchet and pawl mechanism in the output gear assembly 112, and if the inner wheel 134 moved backward in tandem with the outer wheel 115.

Still referring to FIG. 4, a piston guide in the form of a closed loop guide track 172 is built into a top region of the shaft 106 of the charge feeding extruder piston 45'. A stationary guide pin 174 on the housing shell portion **12*b*' slides along the track 172 as the piston shaft 106 advances during a firing mode and as the piston shaft 106 is retracted for reloading. That is, the guide pin 174 remains stationary and the track 172 moves in relation to the stationary guide pin 174. An arm or handle 188 extends from the right side of the rear end of the piston shaft 106. The track 172, guide pin 174 and handle 188** work in a similar manner as the bolt action of a rifle as will be described.

In the embodiment of the invention shown in FIG. 4, the track 172 is located in the shaft 106 opposite the rack 104. However, the track 172 need not be located directly opposite the rack 104, but can be located adjacent the rack 104. Nor does the track have to be recessed. It can be raised. The track 172 has generally the same longitudinal length as the rack 104. In the embodiment shown in FIG. 4, the ends of the track 172 generally coincide with the ends of the rack 104. However, the track 172 and guide pin 174 could be shifted forward or backward from their illustrated position without detracting from the desired operation of the weapon 10'.

Still referring to FIG. 4, the track 172 includes two longitudinal parallel track portions, a firing track portion 176 and a loading/reloading track portion 182. The track 172 also includes two connecting track portions 190 and 192, which bridge front and rear ends, respectively, of the firing track portion 176 and loading/reloading track portion 182. More specifically, the firing track portion 176 has a front end 178 and rear end 180. The loading/reloading track portion 182 also has a front end 184 and rear end 186. The connecting track portion 190 bridges the front ends 178 and 184 of the firing and loading/reloading track portions 176 and 182, respectively. The connecting track portion 192 bridges the rear ends 180 and 186 of the firing and loading/reloading track portions 176 and 182, respectively.

In the embodiment of the invention shown in FIG. 4, the track 172 is defined by a cut-out region in the top surface of the piston shaft 106. Other ways to create the track 172 are within the scope of the invention.

During operation of the weapon 10', the guide pin 174 travels backward along the firing track portion 176 from its front end 178 (when barrel 42' is fully loaded with charge) to its rear end 180 (when barrel 42' is empty). To reload the barrel 42' with charge when the barrel 42' is empty, the handle 188 is moved upward so as to rotate the piston shaft 106 in the counterclockwise direction. As the piston shaft 106 is rotated, the rack 104 disengages from the teeth 117 of the output gear 116. Simultaneously, the guide pin 174 travels along the connecting track portion 192 from the rear end 180 of the firing track portion 176 to the rear end 186 of the loading/reloading track portion 182. Next, the piston shaft 106 is pulled back and retracted from the barrel 42'. As the piston 106 is pulled back, the guide pin 174 travels along the loading/reloading track portion 182 from its rear end 186 to its front end 184. When the guide pin 174 reaches the front end 184, the piston shaft 106 will be fully retracted in the barrel 42'. Next, a fresh charge of flowable semi-solid material is fed into the barrel 42' through fill opening 44'. The handle 188 is then moved downwardly so as to rotate the piston shaft 106 in the clockwise direction. As the piston shaft 106 is rotated, the forward end of the rack 104 re-engages the teeth 117 of the output spur gear 116. Simultaneously, the guide pin 174 travels along the connecting track portion 190 from the front end 184 of the loading/reloading track portion 182 to the front end 178 of the firing track portion 176. The weapon 10' is now ready for another round of firing.

The charge loading apparatus shown in FIG. 4 allows for faster loading and more exciting play action than the screw slot apparatus in the embodiment shown in FIGS. 1 and 2.

Figure 6:
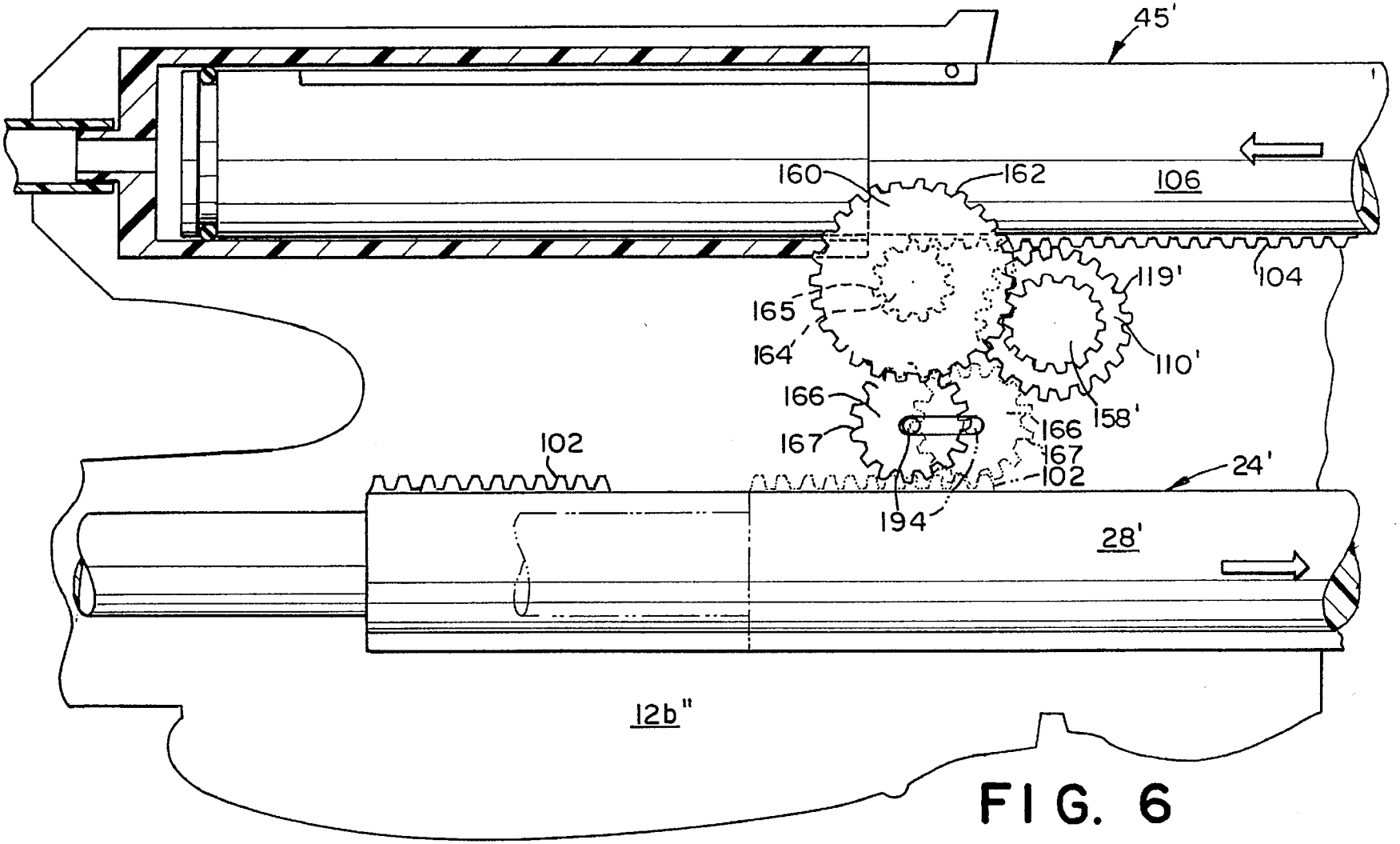
FIG. 6 is a side elevation of part of a third embodiment toy weapon of the present invention showing the differences between it and the second embodiment.

FIG. 6 shows another alternative embodiment of a charge extruding/advancing mechanism. The embodiment in FIG. 6 operates in a similar manner as the embodiment in FIG. 4 to advance the charge feeding extruder piston 45' as the air pump piston 24' is retracted from the fired position. However, the embodiment in FIG. 6 employs a different scheme to prevent the charge feeding extruder piston 45' from moving backward when a charge is fired.

Referring to FIG. 6, gear train 100 of FIG. 4 is replaced by a different combination of gears. The first gear 108 of FIG. 4 is replaced by a toggling first gear 166, the second gear 110 of FIG. 4 is replaced by a similar second gear 110', and the output gear assembly 112 of FIGS. 4 and 5 is replaced by a third gear 160.

Working from output gear to input gear, the third gear 160 has a set of teeth 162 along the outer circumference and an output gear/pinion 164 extending from its center. The output gear/pinion 164 is formed in one body with the third gear 160. The set of teeth 165 on output gear/pinion 164 perform the same functions as the set of teeth 117 and the output gear/pinion 116 of the output gear assembly 112. Since there is no ratchet and pawl mechanism associated with the third gear 160, the output gear/pinion 164 always moves in the same direction as the third gear 160. A holding pawl (not shown) engages the teeth of the third gear 160 for the same purposes as the holding pawl 114 of FIG. 4.

The second gear 110' also has a set of teeth 119' along its outer circumference and a spur gear 158' extending from its center. The spur gear 158' interengages the set of teeth 162 of the third gear 160.

To prevent the charge feeding extruder piston 45' from being driven backward when a charge is fired, the embodiment in FIG. 6 employs a toggling first gear 166, which is movable along a horizontal axis so as to selectively engage and disengage itself from the set of teeth 119' of the second gear 110'. The toggling gear 166 is movable from a first disengaged position shown in solid lines to a second engaged position shown in phantom and back. The toggling first gear 166 has a set of teeth 167 along the outer circumference, in the same manner as the first gear 108.

When a charge is fired by advancing the air pump piston 24' from a fully retracted position to a fully forward position, the teeth of the rack 102 interengage the set of teeth 167 of the first toggling gear 166 as the rack 102 passes under the first toggling gear 166. However, instead of causing the first toggling gear 166 to rotate in the clockwise direction, the initially engaging teeth of the rack 102 (i.e., the leftmost teeth in FIG. 6) push the first toggling gear 166 forward to the first position so that the first toggling gear 166 no longer engages the teeth 119' of the second gear 110'. Accordingly, any further rotation of the first toggling gear 166 caused by the remaining teeth of the rack 102 is not transferred to any other gears, or to the charge feeding extruder piston 45'.

When the piston 45' is retracted from the fired position, the teeth of the rack 102 interengage the set of teeth 167 of the first toggling gear 166 as the rack 102 passes under the first toggling gear 166. As retraction continues, the initially engaging teeth of the rack 102 (i.e., the rightmost teeth in FIG. 6) push the first toggling gear 166 backwards to the second position indicated in phantom so that the first toggling gear 166 interengages the teeth 119' of the second gear 110'. Accordingly, as the air pump piston 24' continues to be retracted, the rotation of the first toggling gear 166 caused by the remaining teeth of the rack 102 is transferred, in succession, to the second gear 110', third gear 160 and the rack 104 of the charge feeding extruder piston 45'.

Figure 7:
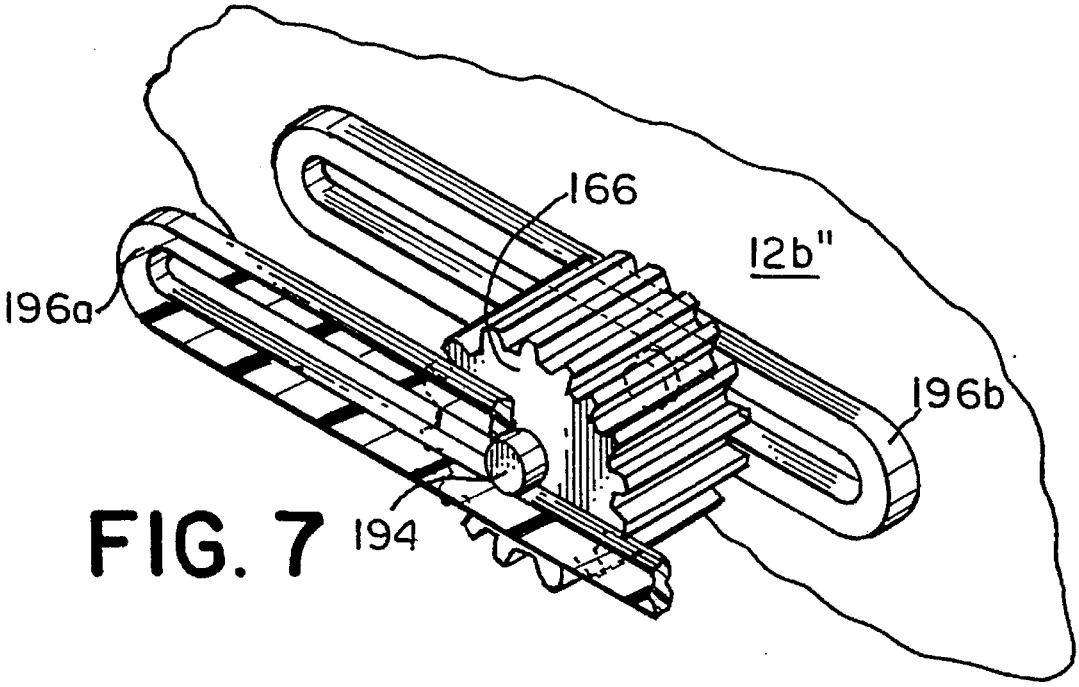
FIG. 7 is a more detailed perspective view showing he mounting of a toggling gear from FIG. 6.

FIG. 7 shows an exemplary mounting of the toggling first gear 166. The toggling first gear 166 is supported by a shaft 194. The ends of the shaft 194 are supported by tracks **196*a*, 196*b*, each molded to project from the inner side wall of housing shell halves 12*a*" and 12*b*"**.

The charge extruding/advancing mechanism shown in FIGS. 6 and 7 has less parts than the mechanism shown in FIGS. 4 and 5 because the four part gear output assembly 112 is replaced by a one piece third gear 60. However, the mechanism shown in FIGS. 6, 7A and 7B requires a slightly more complex structure for supporting the toggling first gear 166, compared to the supporting structure for the first gear 108 of FIG. 4.

The shapeless, semi-solid, flowable material 70 should be safe for children and should extrude relatively easily at room or nominal outdoor temperatures to permit play. Currently materials preferred are plasticized play compositions SLIME™ and GAK™, made by Mattel, Inc., which are commercially available. Other flowable semi-solid materials might be used with varying results including but not limited to various puttys, pastes, caulks, mud, various foods and gelatinized or otherwise thickened liquids.

It will be appreciated that the preferred embodiment is a toy weapon which can be fabricated to be sufficiently light and small to be easily supported by child using only the pistol grip 30, hand grip portion 15 or almost any other grippable part of the toy weapon 10. The present invention provides more realism than the water soaked foam bullet firing weapon of U.S. Pat. 5,241,944 in that the shapeless semi-solid material can be selected with a viscosity which would cause the material to flow and spread over on any object it strikes. The semi-solid material also can be formulated to include a harmless, washable dye like that used in washable marking pens, to mark any object it strikes. It can further be formulated to tend to temporarily adhere to any porous material, such as clothing fabric, which it may contact. In this way, the semi-solid material can be used to record the impact of a projectile and simulate the wound that would be produced thereby.

While a preferred embodiment has been disclosed and some modifications thereto suggested, it will be appreciated that other modifications can be made and will occur to those with skill in the art. For example, while the air pump 20 is axially coaligned with the passageway 61 of the nozzle member 60, such coalignment is not required. Although not desired, it would be possible to mechanically eject a charge **70*a* of the semi-solid material by configuring toy weapon 10 such that the piston 24 can be extended all the way into the nozzle member 60 to physically contact the charge of semi-solid material therein and to mechanically expel that charge through the funnel-shaped constriction 64 and outlet 62. In such case, the O-ring 26 or other air-sealing means provided to form an air pump 20** might be deleted.

While a screw action and rack and pinion extruders 40 and 40' are shown, other types of extruders are well known and can be copied or adapted for use in the toy weapon. For example, a shaft engaged and released by a pivoting lever, as is commonly used in caulking guns, might be employed. Other mechanical arrangements can be provided to controllably advance an extruder piston 45. Similarly, any variety of arrangements other than the longitudinal slots **54*a*, 54*b* and latch member 56 may be used to meter a predetermined charge of the semi-solid material 70 from the extruder reservoir. In particular, a separate pistol grip may be provided surrounding the air pump, extruder or both and movable with respect to a remainder of the housing. Such grip would be coupled with the extruder piston 44 to advance the piston 44 while the air pump piston is being retracted with grip 30**. A ratchet coupling or other one-way clutch mechanism might be provided between such pistol grip and the extruder piston to advance the latter by reciprocation of the former.

In addition, other extruder arrangements are contemplated. For example, an elastic bladder or flexible container can be provided as the semi-solid material reservoir. Semi-solid material can be extruded by rolling up or by otherwise progressively compressing the reservoir externally.

Different arrangements for filling the extruder reservoir are similarly contemplated. These include, but are not limited to permitting the barrel 42 and/or piston 45 to be removable from the housing 12 for supplying semi-solid material in a disposable reservoir or having part of the reservoir/barrel 42, 42' formed by a cover which can be removed or opened for refilling and define part of the barrel/reservoir wall when installed.

While a rigid barrel 22 and slidably mounted piston 24 are preferred for the air pump 20, other arrangements could be provided including, but not limited to, an elastic bladder, a concertina-type bellows or other flexible member, which could be externally collapsed or compressed.

Lastly, it will be appreciated that the gun could be easily modified to shoot more liquid charges by adding a pressure responsive valve at the mouth of the barrel/reservoir, a check valve at the end of tube 52 to prevent backflow and lowering chamber 67 between its ends to form a liquid retaining trap. A check valve may also be needed at the mouth of air pump 20 to prevent water in the trap from being drawn into the air pump.

It will be recognized by those skilled in the art that other changes could be made to the above-described embodiments and proposed embodiments of the invention without departing from the broad inventive concepts thereof. It should be understood, therefore, that the invention is not limited to the particular embodiments disclosed or suggested, but is intended to cover any modifications which are within the scope and spirit of the invention, as defined by the appended claims.

What is claimed is:

1. A toy weapon for firing a charge of a shapeless, flowable, semi-solid material comprising:

a tube having an outlet exposed to atmosphere at one end, a portion of one end of the tube tapers down in internal cross-sectional diameter as the tube extends towards the outlet to define a constriction;

an extruder including a reservoir for a quantity of the shapeless, flowable, semi-solid material, the extruder being fluidly coupled to atmosphere through the tube;

a first piston mounted to reciprocate within the tubes; and a first hand grip coupled with at least one of the extruder, the tube and the first piston; and wherein the extruder is fluidly coupled to the tube between the outlet and the piston.

2. The toy weapon of claim 1 wherein the first hand grip is coupled with the tube and further comprising a separate hand grip coupled with the first piston to reciprocate with the first piston and with respect to the tube and the first hand grip.

3. The toy weapon of claim 1 wherein a portion of the one end of the tube tapers down in internal cross-sectional diameter as the tube extends towards the outlet to define a constriction.

4. The toy weapon of claim 1 further comprising an air seal member on the first piston, the member extending between the first piston and an inner cylindrical surface of the tube.

5. A toy weapon for firing a charge of a shapeless, flowable, semi-solid material comprising:

a tube having an outlet exposed to atmosphere at one end, a portion of one end of the tube tapering down in internal cross-sectional diameter as the tube extends towards the outlet to define a constriction;

an extruder including a reservoir for a quantity of the shapeless, flowable, semi-solid material, the extruder being fluidly coupled to atmosphere through the tube;

a first piston mounted to reciprocate within the tube;

a first hand grip coupled with at least one of the extruder, the tube and the first piston;

an air seal member on the first piston, the member extending between the first piston and the inner cylindrical surface of the tube; and a one-way valve fluidly coupling the tube to atmosphere separately from the outlet and oriented to pass air only from atmosphere into the tube.

6. A toy weapon for firing a charge of a shapeless flowable, semi-solid material comprising:

a passageway having an outlet at one end opened to atmosphere;

an air pump oriented to expel air through the passageway;

a reservoir for the shapeless, flowable, semi-solid material, the reservoir having at least one end opened to atmosphere through the passageway; and a one-way valve fluidly coupled with a barrel of the air pump separately from the outlet and oriented to pass air only from atmosphere into the barrel.

7. A toy weapon for firing a charge of a shapeless flowable, semi-solid material comprising:

a passageway having an outlet at one end opened to atmosphere;

an air pump oriented to expel air through the passageway;

a reservoir for the shapeless, flowable, semi-solid material, the reservoir having at least one end opened to atmosphere through the passageway; and the reservoir being cylindrical and the toy weapon further comprising a second piston in the reservoir.

8. The toy weapon of claim 7 further comprising a first hand grip coupled with the barrel, a second hand grip coupled with the first piston, and a third hand grip coupled with the second piston.

9. A toy weapon for firing a charge of a shapeless flowable, semi-solid material comprising:

a passageway having an outlet at one end opened to atmosphere;

an air pump oriented to expel air through the passageway;

a reservoir for the shapeless, flowable, solid material, the reservoir having at least one end opened to atmosphere through the passageway; and the passageway having an internal surface and wherein a portion of the length of the internal surface tapers down to a constriction as the passageway extends towards the outlet, the constriction being located proximal the outlet.

10. A toy weapon for firing a charge of a shapeless flowable, semi-solid material comprising:

a passageway having an outlet at one end opened to atmosphere;

an air pump oriented to expel air through the passageway;

a reservoir for the shapeless, flowable, solid material, the reservoir having at least one end opened to atmosphere through the passageway;

a compression member movably coupled with respect to the reservoir to reduce storage capacity of the reservoir; and a latch member coupled with the compression member so as to releasably secure the compression member at any of a plurality of positions with respect to the reservoir.

11. A toy weapon for firing a charge of a shapeless flowable, semi-solid material comprising:

a passageway having an outlet at one end opened to atmosphere;

an air pump oriented to expel air through the passageway;

a reservoir for the shapeless, flowable, solid material, the reservoir having at least one end opened to atmosphere through the passageway; and a quantity of the flowable semi-solid material in the reservoir.

12. The toy weapon of claim 8 further comprising a first handgrip coupled with the air pump.

13. The toy weapon of claim 11 wherein the air pump comprises a first piston and a barrel housing the first piston, the barrel defining at least a portion of the passageway.

14. The toy weapon of claim 13 further comprising a first hand grip coupled with the barrel and a second hand grip coupled with the first piston to reciprocate with the first piston and with respect to the barrel and the first hand grip.

15. The toy weapon of claim 13 wherein the barrel, the first piston and the passageway are mutually axially aligned with one another.

16. A toy weapon for firing a charge of a shapeless, flowable, semi-solid material comprising:

a tube having an outlet exposed to atmosphere at one end;

an extruder including a reservoir for quantity of the shapeless, flowable semi-solid material, the extruder being fluidly coupled to atmosphere through the tube;

a first piston mounted to reciprocate within the tube; and first hand grip coupled with at least one of the extruder, the tube and the first piston; and wherein the extruder further includes a second piston which slidably reciprocates within the reservoir, the second piston sliding forward to advance the charge of semi-solid material from the reservoir into the tube for subsequent firing, and backward to allow for reloading of the reservoir.

17. The toy weapon of claim 16 wherein the second piston is elongated and includes a longitudinally extending rack, the weapon further comprising a gear train which couples the first piston to the rack, thereby allowing motion of the first piston to be transferred to the second piston.

18. The toy weapon of claim 17 wherein the second piston is defined by, and rotatable about, a longitudinal axis, the rotation allowing the rack to disengage from the gear train.

19. The toy weapon of claim 17 wherein the gear train has an input gear and an output gear, and wherein the first piston is also elongated and includes a longitudinally extending rack assembly, the gear train being coupled at the input gear to the rack assembly of the first piston and at the output gear to the rack of the second piston.

20. The toy weapon of claim 19 wherein the input gear is supported by a movable shaft, the shaft being movable in a first direction to decouple the input gear from the output gear when the first piston is advanced into the tube, and in a second direction for coupling the input gear with the output gear when the first piston is retracted from the tube.

21. The toy weapon of claim 19 wherein the gear train includes:

a ratchet and pawl mechanism coupled with the output gear so as to transfer rotational movement of the input gear caused when the first piston is retracted from the tube and to slip when the first piston is advanced into the tube.

22. The toy weapon of claim 17 further comprising a stationary guide pin and a piston guide in the second piston for receiving the guide pin.

23. The toy weapon of claim 22 wherein the piston guide includes first and second longitudinal track portions, the guide pin travelling along the first longitudinal track portion during advancement of the second piston into the reservoir, the guide pin travelling along the second longitudinal track portion during withdrawal of the second piston from the reservoir.

24. The toy weapon of claim 23 wherein the piston guide further includes a first connecting track portion between ends of the first and second longitudinal track portions and a second connecting track portion between opposing ends of the first and second longitudinal track portions, the piston guide thereby having a closed-loop configuration.

25. The toy weapon of claim 24 further comprising a handle extending from the second piston to manually rotate the second piston with respect to the reservoir.

26. A toy weapon for firing a charge of a shapeless, flowable, semi-solid material comprising:

a nozzle having an outlet at one end exposed to atmosphere and an internal cross-sectional diameter tapering down as the nozzle extends towards the outlet;

an air pump including a barrel and first reciprocating piston, the barrel and the first piston being axially aligned with the nozzle;

an extruder having an outlet end fluidly between the outlet and the air pump; and a first hand grip coupled with at least one of the extruder and the air pump, the toy weapon being sufficiently small and light to be manually supported by a child with the first hand grip.

27. A toy weapon for firing a charge of a shapeless, flowable, semi-solid material comprising:

a main passageway having one end continuously opened to atmosphere;

a first piston positioned to reciprocate in the main passageway;

an extruder including a reservoir having a feed opening through which the shapeless, flowable, semi-solid material is expelled from the extruder; and a feed passageway continuously opened to atmosphere and having ends terminating only at the reservoir feed opening and at the main passageway between the piston and the open end of the main passageway.

* * * * *